US007186044B2

(12) United States Patent
Bailly

(10) Patent No.: US 7,186,044 B2
(45) Date of Patent: Mar. 6, 2007

(54) EASY-FIT WIPING DEVICE

(75) Inventor: Christian Bailly, Rungis (FR)

(73) Assignee: L'Oreal, Paris (FR)

( * ) Notice: Subject to any disclaimer, the term of this patent is extended or adjusted under 35 U.S.C. 154(b) by 622 days.

(21) Appl. No.: 10/175,398

(22) Filed: Jun. 20, 2002

(65) Prior Publication Data

US 2002/0195117 A1 Dec. 26, 2002

(30) Foreign Application Priority Data

Jun. 26, 2001 (FR) ..... 01 08403

(51) Int. Cl.
*A64B 11/00* (2006.01)

(52) U.S. Cl. ..... 401/122; 132/218

(58) Field of Classification Search ..... 132/218, 132/8, 317, 216; 222/386, 386.5, 389, 563, 222/567, 321.9; 401/121, 122, 207, 126, 401/128, 129; 277/607, 615, 644, 648, 649; 411/509, 510, 913; 220/783, 787, 789, 389, 220/DIG. 10; 15/103, 236, 246, 121
See application file for complete search history.

(56) References Cited

U.S. PATENT DOCUMENTS 3,280,421 A 10/1966 Davidson
4,470,425 A * 9/1984 Gueret ..... 132/218
4,527,807 A * 7/1985 Urbanick ..... 277/642
4,555,046 A * 11/1985 Bennett ..... 222/189.07
4,617,948 A 10/1986 Guéret
4,801,040 A * 1/1989 Kraus ..... 220/787
5,064,102 A * 11/1991 Montaner ..... 222/147
5,201,809 A * 4/1993 Miura ..... 132/218
5,649,713 A * 7/1997 Ledgerwood ..... 277/615
5,875,791 A 3/1999 Sheffler et al.
5,884,634 A 3/1999 Sheffler et al.
5,979,691 A * 11/1999 Von Holdt ..... 220/266
6,503,487 B1 * 1/2003 Ohba ..... 424/64

FOREIGN PATENT DOCUMENTS

| | | |
|---|---|---|
| DE | 296 13 996 | 11/1996 |
| DE | 197 44 181 | 4/1999 |
| EP | 0 659 366 | 6/1995 |
| FR | 2 673 917 | 9/1992 |
| JP | 60-161918 | 10/1985 |
| JP | 1-82816 | 6/1989 |
| JP | 2000-245529 | 9/2000 |

* cited by examiner

*Primary Examiner*—Todd E. Manahan
(74) *Attorney, Agent, or Firm*—Oblon, Spivak, McClelland, Maier & Neustadt, P.C.

(57) ABSTRACT

A wiping device for a container containing a product to be applied by an applicator. The wiping device includes a wiping member and a coupling member configured to couple the wiping device to the container. The coupling member includes a member capable of flexing, bending or moving with respect to the body. In a preferred form, the coupling member wiping device can resist the introduction of the wiping device into the container somewhat less than the coupling member resists the extraction of the wiping device from the container.

67 Claims, 5 Drawing Sheets

150
12
10
13
105
14
15
23
104
106
101
11
16
17
20
21
22

EASY-FIT WIPING DEVICE

CROSS-REFERENCE TO RELATED APPLICATIONS

This application claims priority to French application 0108403 filed Jun. 26, 2001, the entire content of which is hereby incorporated by reference.

BACKGROUND OF THE INVENTION

1. Field of the Invention

The present invention relates to a wiping device for an applicator unit. The applicator unit includes a container in which an applicator can be inserted. The wiping device wipes the applicator as the applicator moves in and out of the container. The wiping device can be particularly advantageous for use in the field of cosmetics, but can also be used in other fields where a wiping type applicator is desirable.

2. Description of the Background

A conventional applicator unit includes a container formed by a body defining an end wall and another end opposite to the end wall. The end opposite to the end wall forms a neck. A free edge of the neck delimits an opening. The body is typically cylindrical. Such a conventional unit also includes an applicator. The applicator includes an applicator member, for example, a mascara brush or an eyeliner, one end of which is secured to a rod. The rod is secured to a stopper configured to removably plug the opening of the container. The stopper forms a member which can be used to grasp the applicator member. When the stopper has been screwed onto the container, the applicator member is immersed in the product contained in the container.

Arranged in the neck of the container is a wiping device, for example, in the form of an annular member. The applicator member passes through the annular member both when the applicator member is introduced into the container through the opening and when the applicator member is withdrawn. The wiping device includes a wiping part in the form, for example, of an annular lip. The applicator member engages one edge of the annular lip. The rod connecting the applicator member to the stopper can also engage the annular lip. Thus, the amount of product remaining on the applicator member can be metered or dosed relatively precisely so as to prevent or reduce the amount excess product present on the applicator member. Furthermore, the rod can be wiped when withdrawing the applicator from the container so that the user's fingers do not get dirty when applying the product.

For certain applications, it is useful to use a wiping device with a wiping part made of an elastically deformable material, for example, natural or synthetic rubber. This is the case, for example, for applicators with a cross section that varies appreciably over its length, for applicators configured to pick up a small amount of product, and for applicators with a small cross section relative to the rod. A wiping device made of such an elastically deformable material is described in U.S. Pat. No. 4,617,948. The wiping device disclosed in that patent is placed on an internal edge of the container, and held in place by an additional part forming a threaded neck. Such an arrangement, by entailing that the container be made in two parts, increases the number of assembly operations and raises the manufacturing cost of the unit.

FIGS. 1A and 1B illustrate a conventional wiping device 1. The wiping device 1 is made of elastomer and is configured to fit into a container. Such a wiping device 1 includes a body 2 of cylindrical overall shape. The body 2 and the neck of the container can be formed as a single piece. One of the ends of the body 2 terminates in a rim 3 configured to bear against the edge of a container. A bulge 4 is formed near the rim 3 to improve the seal between the container and the wiping device 1. Near the opposite end of the rim 3, the wiping device ends in an internal edge 5 of reduced section by comparison with the section of the body 2. The edge 5 forms a wiping member. On the outside of the body 2, the wiping device 1 forms a solid bulge 6 configured to secure the wiping device 1 to the container. Once the bulge 6 has entered the neck of the container, the bulge 6 is configured to position itself behind the shoulder of the container, thus immobilizing the wiping device 1 in a position such that the wiping device I is secured to the container.

Because of the elastically deformable nature of the material of which the wiping device 1 is formed, the bulge 6 has to have sufficient radial width (typically of the order of a millimeter) to secure the wiping device 1 firmly to the container. Such a system presents a drawback because the bulge 6 renders the insertion of the wiping device into the neck of the container difficult. The insertion is particularly difficult when performed using an industrial tool. In practice, such an industrial tool can include a rod introduced into the wiping device 1. The wiping device 1 is positioned above the neck of the container, and is pushed in the container in response to pressure exerted axially on the rod. Experience shows that the high resistance generated by the bulge 6 can cause the fitting tool to damage the wiping device 1. Similar wiping devices with one or more relatively "solid" bulges are also described in U.S. Pat. No. 5,884,634 and U.S. Pat. No. 5,875,791.

SUMMARY OF THE INVENTION

One of the objects of the invention is to provide a wiping device which fully or partially solves the problems discussed hereinabove with reference to the conventional wiping devices.

Another object of the invention is to provide a wiping device at least part of which is made of elastically deformable material, which is simple to fit and, once fitted, is secured to the container.

Another object of the invention is to provide a wiping device which is economical to produce.

Yet another object of the invention is to provide a wiping device configured to fit in a container that contains a product to be applied by an applicator. The wiping device can be at least partly made of an elastically deformable material. The wiping device can include a body, a wiping portion, and a member configured to couple or catch the wiping device on the container. The catching or coupling member can include at least one flexible lip which extends continuously or discontinuously on the exterior surface of the body and has a first end attached to the body of the wiping device at a joining region. Catching members other than lips can be used to implement the present invention. A second end of the lip can be free. In the absence of stress, the lip is preferably oriented at an acute angle with respect to the body, preferably not zero, so as to exhibit during the introduction of the wiping device into the container, a resistance substantially less than the resistance exhibited during the extraction of the wiping device from the container.

With the wiping device according to the invention, an axial stress exerted on the body of the wiping device causes the lip to flex elastically with respect to the body in a first direction. An axial stress exerted on the body in the opposite direction causes the lip to flex elastically with respect to the body in a different second direction. Thus, axial stress exerted in a first direction on the coupling member causes the lip, as an umbrella, to flex elastically in such a way as to move its free part closer to the body. By contrast, the same axial stress exerted in the opposite direction to the first causes the lip to flex elastically in such a way as to cause the free part of the lip to move away from the body, at least initially. In a preferred embodiment, the flexing movement describes a pivoting or rocking movement approximately about the joining region that connects the lip to the body of the wiping device.

In a preferred embodiment, the diameter of the lip decreases as the wiping device is introduced into the neck of the container, in response to an axial thrust exerted on the wiping device. The wiping device is therefore easy to introduce. By contrast, after insertion into the neck of the container, the diameter of the lip increases, i.e., the lip "deploys" radially, so as to oppose the removal of the wiping device when an axial tension is exerted on it. The "ease of fitting" and "secure coupling" functions are thus fulfilled satisfactorily without one function being favored at the expense of the other. While the term "diameter" is used above, this term is not intended to limit the catching or coupling member of the present invention to circular members. In more general terms, the outer dimension of the catching or coupling member in the plane perpendicular to the longitudinal axis of the wiping device decreases and increases as the wiping device enters and exits the neck of the container.

The body of the wiping device can include a tubular element including a first end configured, when the wiping device is mounted on the container, to face an end wall of the container, and a second end at the opposite end to the first. In a preferred embodiment, the joining region between the lip and the body of the wiping device is arranged a non-zero distance away from the first end of the body. Thus, the body of the wiping device defines, under the joining region, a skirt portion allowing the wiping device to be positioned in the opening delimited by the neck of the container before the axial thrust aimed at completely inserting it into the neck of the container is exerted.

The part of the body of the wiping device configured to be in the neck, i.e., the part between the upper rim and the coupling member, may have an outside diameter such that the part is clamped slightly inside the neck. However, this feature is optional.

In a preferred embodiment, the angle between the lip and the body is from 30° to 60°, and more preferably from 35° to 55°, and more preferably still about 45°. The angle can be chosen according to the material of the coupling member and according to the desired secureness of the coupling.

The wiping member can be formed of an interior edge of the tubular element, this interior edge having a reduced section by comparison with the section of the tubular element. The interior edge can be a non-zero distance away from the first end. The diameter of the edge of reduced section can be chosen according to the desired wiping of the applicator member and/or according to the diameter of the rod connecting the applicator member to the grasping member.

The edge of the first end can itself form an element with which all or part of the applicator member engages as it is extracted. In this embodiment, the edge of the first end and the edge of reduced section form two levels of wiping for the applicator member.

The interior edge of reduced section may be situated axially between the first end and the joining region, a non-zero distance away from the latter. This feature assists in reducing excess rigidity in the wiping device near the joining region. Excess rigidity can render the wiping device more difficult to introduce into the container.

Advantageously, the edge of the reduced section can be formed by the free edge of an annular lip inclined towards the first end. The angle of inclination of the lip can be, for example, on the order of about 45°.

In a preferred embodiment, the second end of the tubular element forms a rim configured to bear against an edge of the container delimiting an opening thereof.

In another preferred embodiment, at least the wiping member and the coupling member are made of an elastically deformable material. Preferably, the entirety of the wiping device is made of an elastically deformable material. The elastically deformable material may be chosen, for example, from thermoplastic or crosslinked elastomers, for example, EPDMs, natural rubbers and nitrile, butyl or silicone elastomers. In the case of a crosslinked elastomer, the wiping device can be manufactured in a compression mould, heated to the appropriate temperature.

According to another embodiment, a first portion of the wiping device can be made of a first material which is elastically deformable. The coupling member and the wiping member can be arranged on the first portion. A second portion can be made of a second material different from the first. The wiping device can be made, for example, by two-shot injection molding or overmolding. To this end, particularly in the case of two-shot injection molding, two physico-chemically compatible materials are preferably used. The second material preferably includes a polyolefin, for example, a polypropylene or a polyethylene.

According to another embodiment of the invention, an applicator unit is provided. The applicator unit includes a container for containing a product, and an applicator member immersed in the product and which can be used to apply the product. The unit is fitted with a wiping device according to any of the embodiments of the invention disclosed above. The applicator member passes through the wiping device when the applicator member is withdrawn from the container, so as to reduce the excess amount of product on the applicator member.

In a preferred embodiment, the container is formed of a body separated from a neck by a shoulder. A free edge of the neck delimits an opening near which the wiping device is mounted. Such a container can be obtained by molding a material such as a polypropylene.

Advantageously, when the wiping device has been mounted on the container, the coupling member is more or less in abutment against the shoulder. In this position, the coupling member is arranged under the shoulder, and can abut against the shoulder. In a preferred embodiment, when the wiping device has been mounted on the container, the coupling member can be elastically stressed. In other words, the lip can be flexed against the shoulder of the container. This feature avoids the problems associated with the manufacturing tolerances on the wiping device relative to the height of the neck of the container.

The applicator member can be secured, via a connecting element, to a grasping member. The grasping member can form an element configured to removably plug the opening. Preferably, the grasping member forming the stopper is screwed onto the neck of the container.

The applicator member can be, for example, an applicator for the eyelashes or eyebrows, e.g., in the form of a twisted or molded brush, a brush of the paintbrush type, an eyeliner, a block of foam, a frit, a pen or a felt. The product in the container can be a cosmetic product, or another type of product applied to the applicator, with the wiping device preventing or reducing the presence of excess amounts of the product on the applicator when the applicator is removed from the container.

BRIEF DESCRIPTION OF THE DRAWINGS

A more complete appreciation of the invention and many of the attendant advantages thereof will be readily obtained as the same becomes better understood with reference to the following detailed description particularly when considered in conjunction with the accompanying drawings, in which.

DESCRIPTION OF THE PREFERRED EMBODIMENTS

Figure 1A:
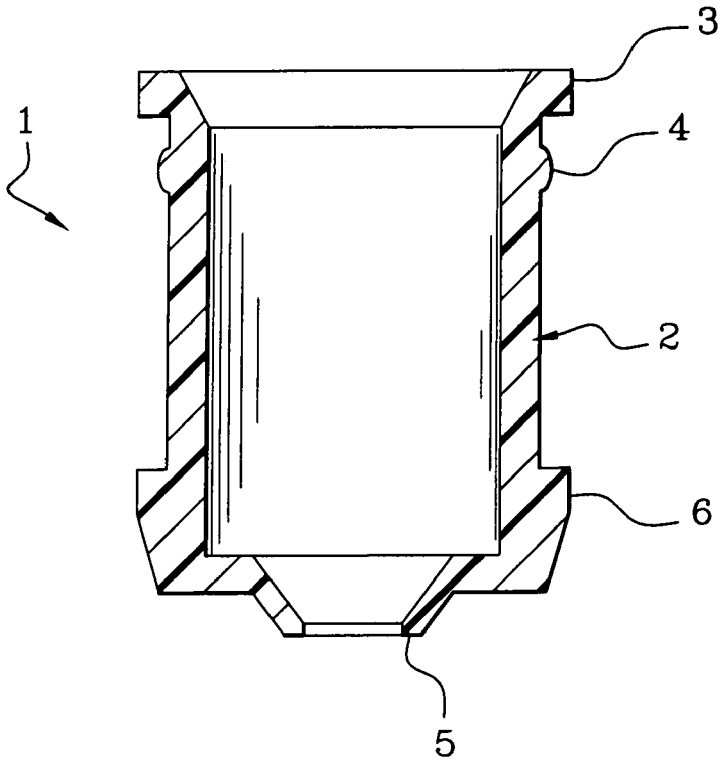
Fig. 1A Prior Art
FIGS. 1A–1B illustrate a conventional wiping device.
Figure 1B:
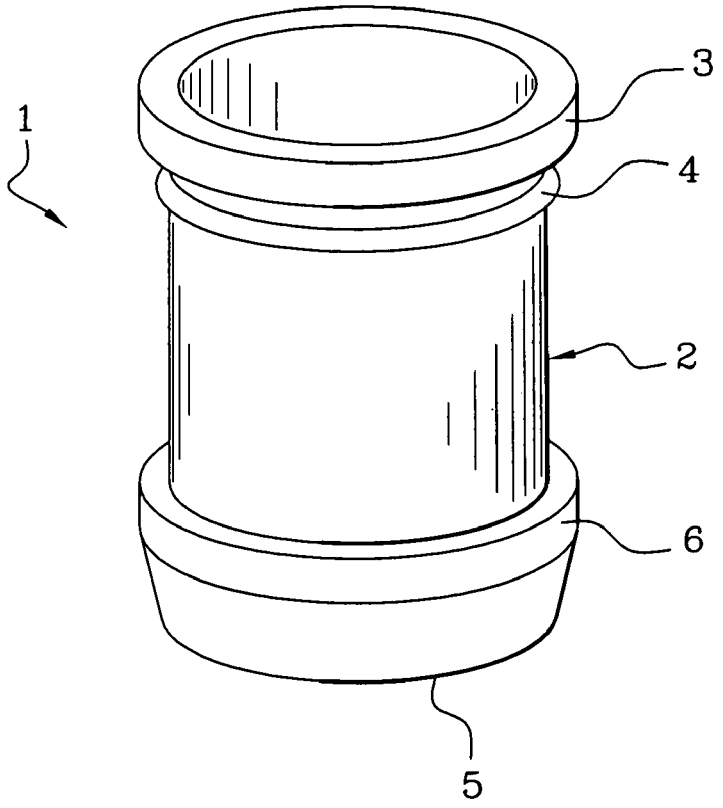
Fig. 1B Prior Art
Figure 2A:
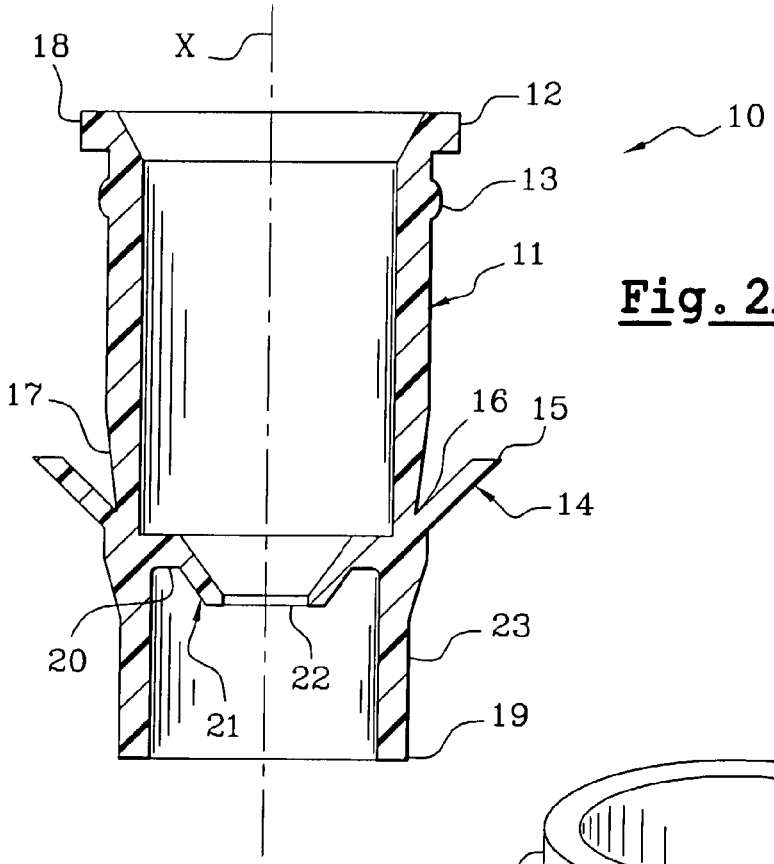
FIGS. 2A–2B illustrate a wiping device according to an embodiment of the present invention.
Figure 2B:
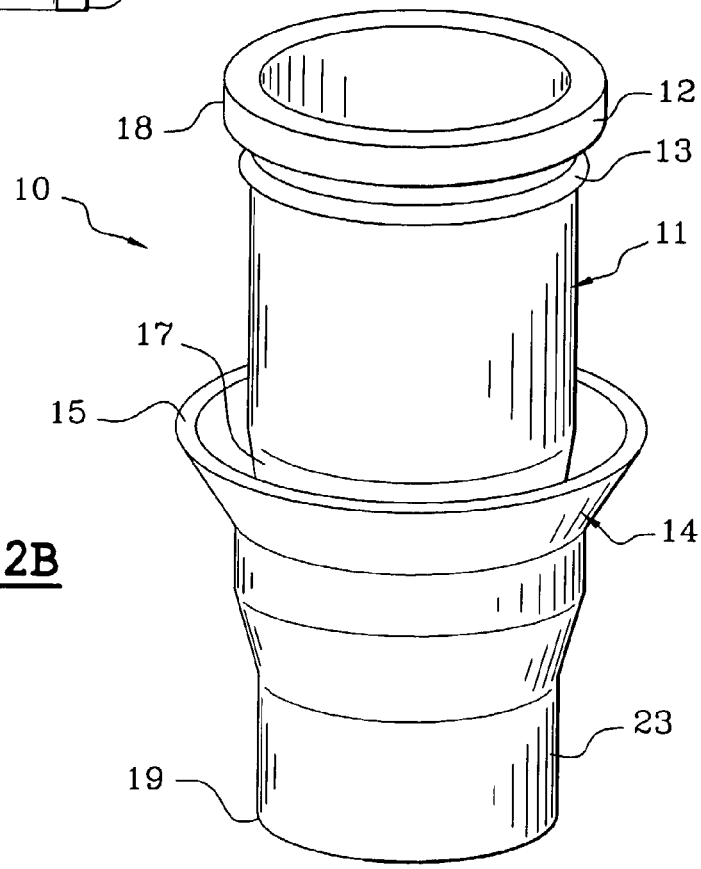

The wiping device 10 depicted in FIGS. 2A and 2B includes a tubular body 11 having a roughly cylindrical shape. Of course, the shape of the body 11 is not limited to a cylindrical shape. The wiping device 10 according to this non-limiting embodiment is made of EPDM. One end 18 of the tubular body 11 has a protruding member 12 configured to bear, as will be seen later, against the edge of a container. In the non-limiting example shown in FIGS. 2A–B, the protruding member 12 is a rim 12. Under this rim 12, the exterior surface of the body 11 can form a bulge 13 configured to improve the seal between the wiping device 10 and the neck of the container.

A member 14 protrudes from an outer surface of the body 11 so as to form an acute angle with the body when the member 14 is not stressed or, in other words, does not have a force applied thereto. The member 14 is a movable member, for example, by providing the member as a bendable member, so that the member can move toward the wiping device upon insertion into the container, but the movable member abuts against the container after insertion. Although in the preferred form illustrated, the member is movable by bending or deformation, it is to be understood that other expedients could also be utilized to render the member 14 movable. In the non-limiting embodiment shown in FIGS. 2A–B, the bendable member 14 is an annular lip 14 located between the two ends of the body, about two-thirds along the axial height of the wiping device 10, as measured from the rim 12. As shown in FIG. 2B, the annular lip 14 can form a skirt around the body 11. In the non-limiting embodiment shown in FIG. 5, three bendable members 14', 14", and 14''' protrude from the outer surface of the body 11. In these examples, the bendable members 14, 14', 14", and 14''' are inclined at about 45° with respect to the tubular body 11, and have a free end 15 facing upwards. However, it is to be understood that other angles can be used in accordance with the present invention. Preferably, the lip or bendable member is oriented at an angle of 30° to 60°, more preferably, 35° to 55° with respect to the body.

Returning to FIGS. 2A–B, the annular lip or bendable member 14 is connected to the tubular body 11 via an annular joining zone 16 running roughly in a plane perpendicular to an axis X of the wiping device 10. This joining zone 16 is positioned at a distance from the end 19 of the body. Facing the lip or bendable member14, and over a height corresponding roughly to the height thereof, the exterior surface of the tubular body 11 forms a depression or indentation 17, the depth of which decreases gradually from the joining region 16. In a preferred embodiment, the body 11 defines an indentation 17 having a form compatible with the bendable member 14. The bendable member 14 can be positioned in the indentation 17 when the bendable member 14 is bent against the body 11 (as described below in relation to FIG. 4C).

Below the lip 14, the body 11 has a portion 23 of roughly cylindrical external section running as far as the end 19 of the tubular body 11. Inside the tubular body 11, under the joining region 16, is formed a transverse collar 20 connecting to a lip 21 inclined by about 45° in the direction of the end 19 of the tubular body 11. Of course, other angles can be used in accordance with the present invention. A free edge 22 of the lip 21 determines the wiping diameter of the wiping device 10. This wiping member 21 is positioned between the joining region 16 and the end 19 of the body 11. While the wiping member illustrated in this non-limiting example is a lip 21, other forms of wiping members could also be used. In the absence of stress, the diameter of the edge 22 is smaller than the maximum diameter of the applicator member for which the wiping device 10 is intended.

Figure 3:
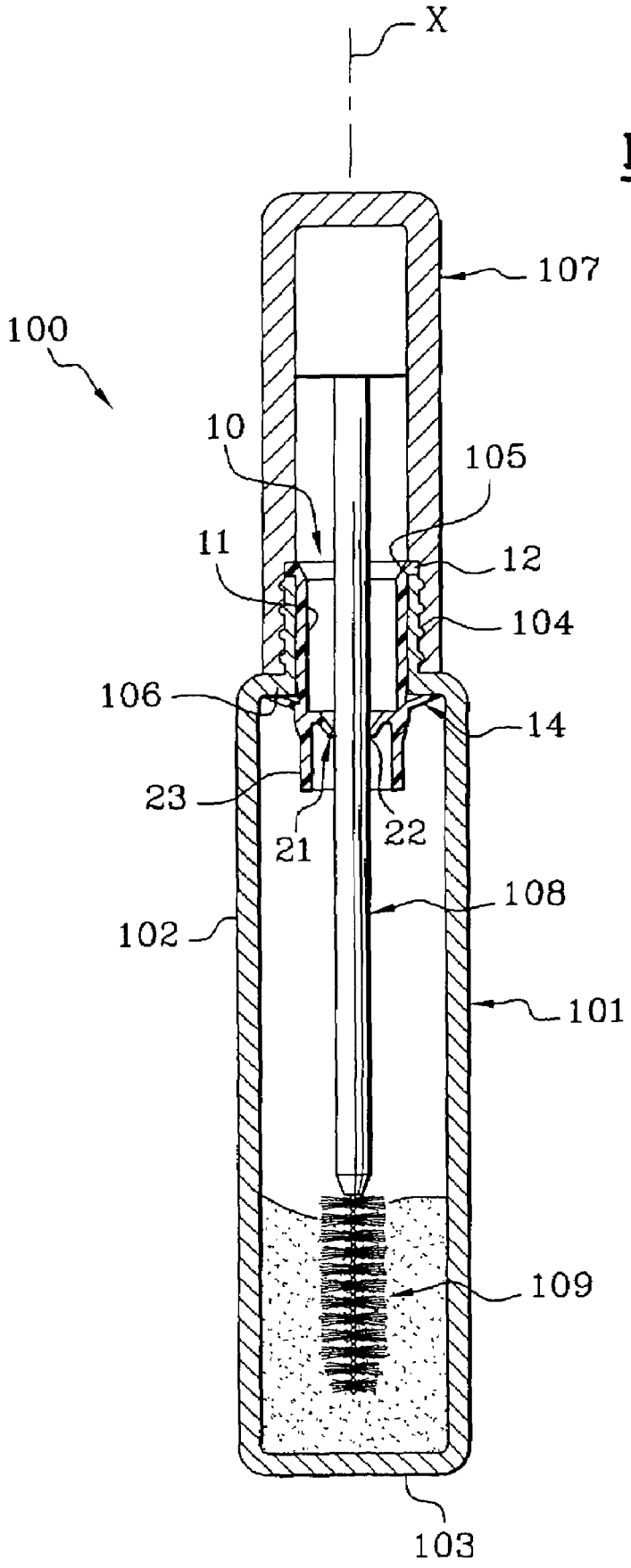
FIG. 3 is a sectional view of an applicator unit equipped with a wiping device according to an embodiment of the present invention.

FIG. 3 depicts a view in longitudinal section of a unit 100 for packaging and applying mascara. The unit 100 is equipped with a wiping device 10 as described with reference to FIGS. 2A–2B. Such a unit 100 includes a container 101 with a cylindrical body 102 one end of which is closed by an end wall 103. At the opposite end to the end wall 103, the body 102 is surmounted by a threaded neck 104, a free end of which delimits an opening 105. The neck 104 is connected to the cylindrical body 102 by a shoulder 106.

Mounted in the neck 104 is a wiping device 10 as discussed with reference to FIGS. 2A and 2B. In this fitted position, the lip 14 is arranged under the shoulder 106 while being stressed elastically slightly against the shoulder 106. In this position, the radial width of the lip 14 is at a maximum. In this mounted position, the rim 12 of the wiping device bears against the edge of the container delimiting the opening 105. The diameter of the lip 14 in this position is greater then the diameter of the rim 12. The annular bulge 13 provides a good seal between the wiping device 10 and the internal surface of the neck 104.

Screwed onto the threaded neck 104 is a cap 107. Although a screw-cap is illustrated, other mating relationships of the cap could also be utilized. The cap 107 is secured to a rod 108 of which one end, the opposite end to the cap 107, is secured to a mascara brush 109. The mascara brush can be molded or formed from a twisted iron wire trapping a helical arrangement of bristles. In this position, in which the cap 107 is screwed onto the neck 104, the applicator 109 is more or less at the bottom of the container 101 and is in contact with the product contained therein. The rod 108 passes through the wiping device 10 and has a portion engaged with the wiping edge 22 of the lip 21.

In use, the user unscrews the cap 107 and, with a movement which is roughly axial in a direction away from the end wall 103, extracts the mascara brush 109 from the container 101. During this extraction movement, the rod 108 is wiped by the wiping edge 22 of the lip 21. Excess product on the brush 109 is removed as the latter passes across the wiping edge 22. After application, the unit can be closed using an action that is the opposite of the one described for extracting the applicator 109.

FIGS. 4A–4E illustrate the steps of mounting a wiping device 10 as described in FIGS. 2A–2B on a packaging and applicator unit as depicted in FIG. 3.

Figures 4A, 4B, 4C, 4D, 4E:
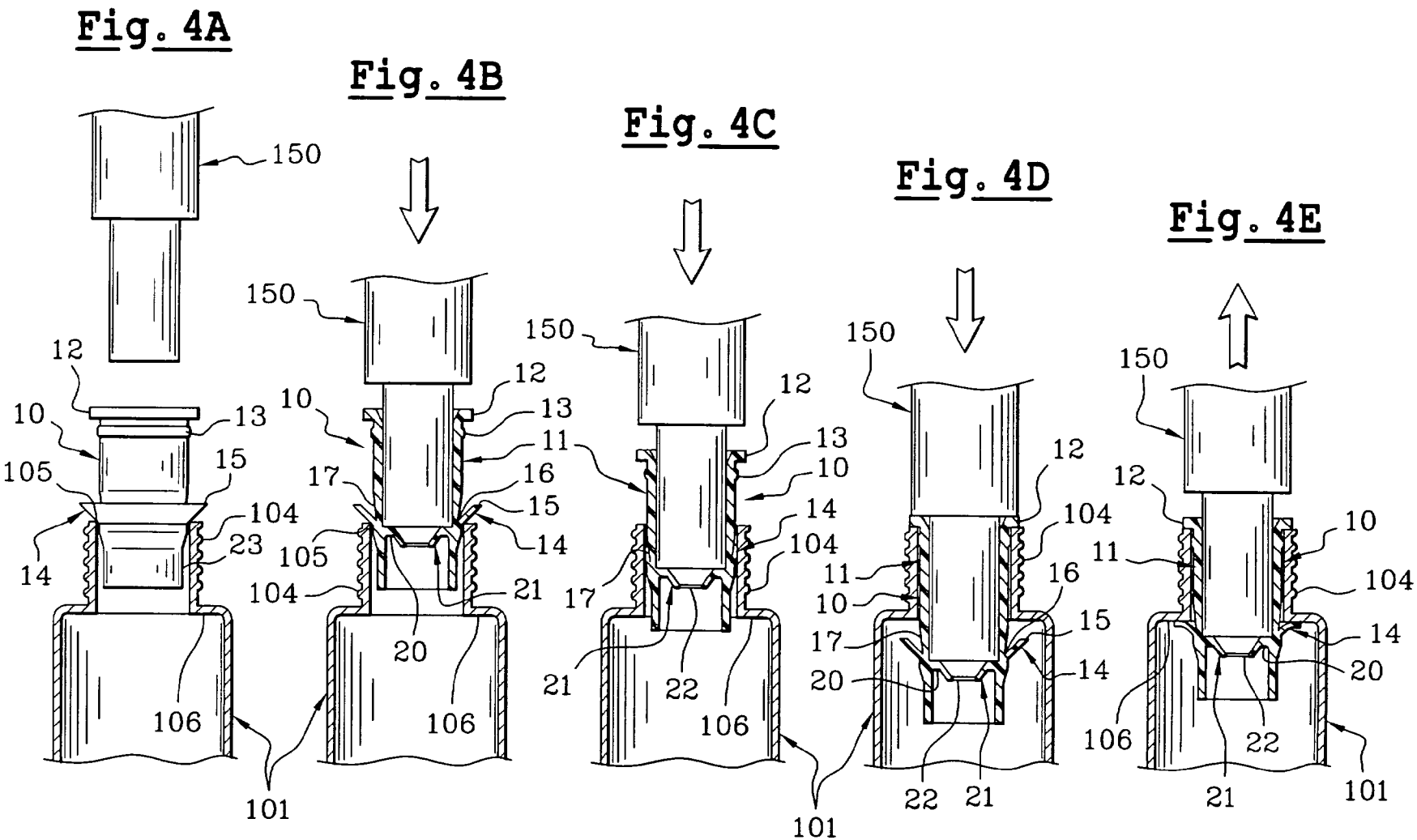
FIGS. 4A–4E illustrate the various steps in fitting a wiping device according to an embodiment of the invention on the applicator unit of FIG. 3.

In FIG. 4A, the cylindrical portion 23 of the wiping device 10 is arranged inside the neck 104. The lip 14 forms a stop retaining the wiping device 10 in this position. In FIG. 4B, a tool of elongate shape 150 is introduced into the wiping device 10 until the tool 150 comes into abutment against the transverse collar 20 of the wiping device 10. By continuing to move the tool 150 axially towards the bottom of the container (FIG. 4C), the wiping device 10 is engaged further into the neck 104 of the container. As this happens, the lip 14 of the wiping device 10 bends towards the tubular body 11. In other words, in the illustrated embodiment, the member 14 moves from an unbent position (FIG. 4B) to a bent position (FIG. 4C), which is closer to the body 11 than the unbent position. Accordingly, the diameter of the member 14 in the unbent position (FIG. 4B) is greater than the diameter of the member 14 in the bent position (FIG. 4C). In a preferred embodiment, the lip 14 becomes lodged or disposed in the depression or indentation 17 so that the lip 14 forms practically no additional thickness with respect to the external surface of the tubular body 11. Thus lodged in the depression 17, the lip 14 does not appreciably affect the downwards movement of the wiping device inside the neck 104 of the container 101.

In a preferred embodiment, the protruding member 12 at the end 18 of the body 11 has a diameter smaller than the diameter of the member 14 in the unbent position (FIGS. 4B and 4D). However, the diameter of the protruding member 12 is greater than the diameter of the member 14 in the bent position (FIG. 4C). In yet another preferred embodiment, the end 19 of the body 11 has a diameter smaller than the diameter of the member 14 in the unbent position (FIGS. 2B and 4B). Furthermore, the diameter of the end 19 is preferably smaller than the diameter of the protruding member 12 (see FIG. 2B).

The downwards movement of the wiping device 10 in the neck 104 continues until the free end 15 of the lip 14 no longer faces the neck 104 (FIG. 4D). In that position, the wiping device 10 is slightly stressed in elongation and the lip 14 deploys radially to return to its initial shape at 45°. The rim 12 of the wiping device 10 bears against the edge of the container 101.

In FIG. 4E, the tool 150 is beginning its withdrawal movement in the direction away from the bottom of the container. Through elastic return, the lip 14 is stressed into engagement against the shoulder 106, and thus resists movement attempting to pull out the wiping device 10. The wiping device 10 is firmly secured in the neck 104 of the container. In other words, the member 14 moves from an unbent position (FIG. 4D) to a bent position (FIG. 4E), which is further away from the body 11 than the unbent position. In the preferred form illustrated, the diameter of the member 14 in the unbent position (FIG. 4D) is smaller than the diameter of the member 14 in the bent position (FIG. 4E).

While the term "diameter" is used above to describe a preferred embodiment of the present invention, this term is not intended to limit the member 14, the protruding member 12, and the end 19 of the present invention to circular members. Instead, the term "diameter" is used as a non-limiting example of the more generic term "outer dimension" for these members. For example, the "outer dimension" of the member 14 shown in FIGS. 2A–B is the outer diameter of the member 14 in the plane perpendicular to the longitudinal axis X of the wiping device 10. Similarly, the "outer dimension" of the protruding member 12 shown in FIGS. 2A–B is the outer diameter of the protruding member 12 in the plane perpendicular to the X axis. By way of example, the outermost surface of the lip 14 could have shapes other than curved/circular, such as a flattened or scalloped shape/profile.

Figure 5A:
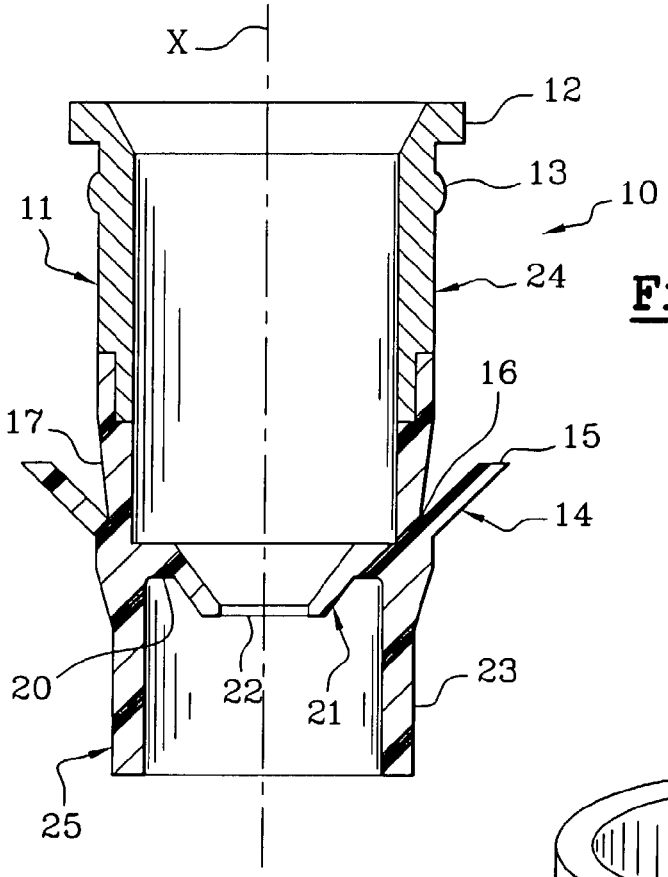
FIGS. 5A and 5B illustrate other embodiments of the wiping device according to the present invention.
Figure 5B:
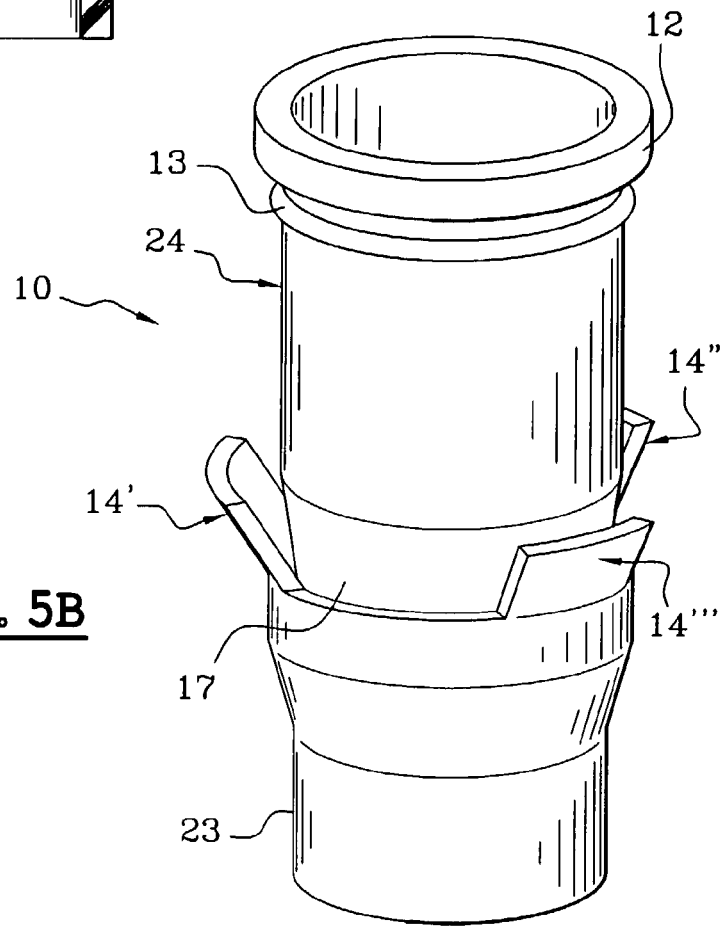

In the alternative embodiment shown in FIG. 5B, the coupling member includes a lip in the form of a number of discontinuous sectors 14', 14", 14'''. These sectors can be uniformly spaced around the entire periphery of the tubular body 11. This arrangement plays a part in further reducing the resistance of the coupling member to the introduction of the wiping device. Furthermore, it requires a smaller amount of material than is required by the previous embodiment.

In the alternative embodiment shown in FIG. 5A, the wiping device 10 is made of two different materials. Thus, according to the preferred embodiment of this wiping device 10, the upper part 24 of the tubular body 11, and the rim 12, are made of polyethylene. The remainder 25, including the coupling member 14 and the wiping member (20–22) is overmolded with the upper part 24, using a material known by the trade name of Santoprene®. Systems involving beads, not depicted, couple the two parts 24 and 25 together.

According to another embodiment of the wiping device 10 shown in FIG. 5A, the wiping device 10 is made by two-shot injection molding of two physico-chemically compatible materials.

The presence of a rigid part to form the upper part of the wiping device 10 makes it easier for the wiping device to be introduced into the neck 104 of the container without having to use a tool that is inserted into the tubular body 11. Indeed, in this embodiment, simple pressure exerted directly on the "rigid" rim 12 of the wiping device 10 is enough to push it into the neck 104 of the container.

Obviously, numerous modifications and variations of the present invention are possible in light of the above teachings. It is therefore to be understood that within the scope of the appended claims, the invention may be practiced otherwise than as specifically described therein.

What is claimed as new and desired to be secured by Letters Patent of the United State is:

1. A wiping device configured to be inserted in a container, comprising:

a body with two ends, each end defining an opening configured to receive an applicator;

a wiping portion on an inner surface of said body and configured to wipe said applicator when said applicator passes through said body; and a coupling member configured to couple the wiping device to the container, wherein:

said coupling member includes a flexible lip on the exterior surface of the body, said flexible lip has a first end attached to the body at a joining region and a second end which is free, and said first end having a surface which faces said body and which is connected to said body at an acute angle so that said flexible lip exhibits, during an introduction of the wiping device into the container, a resistance substantially less than a resistance exhibited during extraction of the wiping device from the container, after the wiping device is mounted on the container, the flexible lip is in a flexed position and an outer dimension of said flexible lip is greater in said flexed position than in an unflexed position.

2. The wiping device according to claim 1, wherein said angle is from 30° to 60°.

3. The wiping device according to claim 2, wherein said angle is from 35° to 55°.

4. The wiping device according to claim 3, wherein said angle is about 45°.

5. The wiping device according to claim 1, wherein the flexible lip is annular around said body.

6. The wiping device of claim 1, wherein:

said body has a first end and a second end, said wiping portion is positioned between said first end and said second end, said flexible lip is coupled to said body at a joining region, and said wiping portion is positioned between said first end and said joining region.

7. The wiping device of claim 1, further comprising said applicator inserted into the openings of said ends of said body.

8. The wiping device of claim 7, wherein said lip is an annular lip.

9. The wiping device of claim 1, wherein said wiping member comprises a lip extending from said inner surface of said body.

10. An applicator unit comprising:

a container containing a cosmetic product;

a wiping device according to claim 1; and said applicator being immersed in said cosmetic product, wherein said applicator is configured to pass through said wiping device when the applicator is withdrawn from the container, so as to remove excess product from the applicator.

11. A wiping device configured to be inserted in a container, comprising:

a body with two ends, each end defining an opening configured to receive an applicator member;

a wiping portion on an inner surface of said body and configured to wipe said applicator member when said applicator passes through said body; and a coupling member configured to couple the wiping device to the container, wherein:

said coupling member includes a flexible lip on the exterior surface of the body, said flexible lip has a first end attached to the body at a joining region and a second end which is free, and wherein the exterior surface of the body has, facing the flexible lip, a depression so as to reduce the resistance of said flexible lip to the introduction of the wiping device into the container.

12. The wiping device according to claim 11, wherein the body comprises a tubular element having a first end facing a bottom wall of the container, and a second end at the opposite end to the first end.

13. The wiping device according to claim 12, wherein said joining region is spaced from said first end of the body.

14. The wiping device according claim 12, wherein the wiping portion is formed of an interior edge of the tubular element, said interior edge being a non-zero distance away from said first end.

15. The wiping device according to claim 14, wherein said interior edge is situated axially between the first end and said joining region, a non-zero distance away from the joining region.

16. The wiping device according to claim 14, wherein said interior edge comprises the free edge of an annular lip inclined towards the first end.

17. The wiping device according to claim 12, wherein the second end of the tubular element forms a rim configured to bear against an edge of the container delimiting an opening thereof.

18. The wiping device according to claim 11, wherein at least the wiping portion and the flexible lip are made of an elastically deformable material.

19. The wiping device according to claim 18, wherein said elastically deformable material is selected from the group consisting of thermoplastic and cross-linked elastomers.

20. The wiping device according to claim 18, wherein said elastically deformable material is selected from the group consisting of EPDMs, natural rubbers, nitrile, butyl and silicone elastomers.

21. An applicator unit comprising:

a container containing a product;

a wiping device according to claim 6; and said applicator member immersed in said product, wherein said applicator member is configured to pass through said wiping device when the applicator member is withdrawn from the container, so as to remove excess product from the applicator member.

22. The unit according to claim 21, wherein the container comprises a body separated from a neck by a shoulder, a free edge of the neck delimiting an opening near which said wiping device is mounted.

23. The unit according to claim 22, wherein, when the wiping device is mounted on the container, the flexible lip abuts against the shoulder.

24. The unit according to claim 23, wherein, when the wiping device is mounted on the container, the flexible lip is elastically stressed.

25. The unit according to claim 21, wherein the applicator member is secured, via a connecting element, to a grasping member configured to removably plug said opening.

26. The unit according to claim 21, wherein the applicator member is one of an applicator for eyelashes or eyebrows, an eyeliner, a brush, a block of foam, a frit, a pen and a felt.

27. The wiping device of claim 11, wherein in the absence of stress, said flexible lip makes an acute angle with the body so as to exhibit, during an introduction of the wiping device into the container, a resistance substantially less than a resistance exhibited during extraction of the wiping device from the container.

28. A wiping device configured to be inserted in a container, comprising:

a body with two ends, each end defining an opening configured to receive an applicator;

a wiping portion on an inner surface of said body and configured to wipe said applicator member when said applicator passes through said body; and a coupling member configured to couple the wiping device to the container, wherein:

said coupling member includes a flexible lip on the exterior surface of the body, said flexible lip has a first end attached to the body at a joining region and a second end which is free, and said first end having a surface which faces said body and which is connected to said body at an acute angle so that said flexible lip exhibits, during an introduction of the wiping device into the container, a resistance substantially less than a resistance exhibited during extraction of the wiping device from the container, wherein the exterior surface of the body has, facing the flexible lip, a depression so as to reduce the resistance of said flexible lip to the introduction of the wiping device into the container.

29. An applicator unit comprising:

a container containing a cosmetic product;

a wiping device according to claim 28; and said applicator being immersed in said cosmetic product, wherein said applicator is configured to pass through said wiping device when the applicator is withdrawn from the container, so as to remove excess product from the applicator.

30. A wiping device configured to be inserted in a container, comprising:

a body;

a wiping portion; and a coupling member configured to couple the wiping device to the container, wherein:

said coupling member includes a flexible lip on the exterior surface of the body, said flexible lip has a first end attached to the body at a joining region and a second end which is free, and in the absence of stress, said flexible lip makes an acute angle with the body so as to exhibit, during an introduction of the wiping device into the container, a resistance substantially less than a resistance exhibited during extraction of the wiping device from the container, wherein:

said coupling member and the wiping portion are made of a first material, which is elastically deformable, and an upper portion of said body is made of a second material, different from the first material.

31. The wiping device according to claim 30, wherein the second material includes a poly0lefin.

32. The wiping device according to claim 30, wherein said second material includes a polypropylene or a polyethylene.

33. The wiping device according to claim 30, wherein, after the wiping device is mounted on the container, the flexible lip is in a flexed position and an outer dimension of said flexible lip is greater in said flexed position than in an unflexed position.

34. An applicator unit comprising:

a container containing a cosmetic product;

an applicator immersed in said cosmetic product; and a wiping device according to claim 30;

wherein said applicator is configured to pass through said wiping device when the applicator is withdrawn from the container, so as to remove excess product from the applicator.

35. A wiping device to be inserted in a container, comprising:

a body with two ends, each end defining an opening configured to receive an applicator;

a wiping member on an inner surface of said body and configured to wipe said applicator when said applicator passes through said body; and at least one bendable member protruding from an outer surface of said body, said bendable member having a surface which faces said body and which is connected to said body at an acute angle when said bendable member is unbent, after the wiping device is mounted on the container, the bendable member is in a bent position and an outer dimension of said bendable member is greater in said bent position than in an unbent position.

36. The wiping device of claim 35, comprising at least two bendable members protruding from said outer surface of said body, each of said at least two bendable members having a surface which faces said body and which is connected to said body at an acute angle when said bendable members are unbent.

37. The wiping device of claim 35, comprising at least three bendable members protruding from said outer surface of said body, each of said at least three bendable members having a surface which faces said body and which is connected to said body at an acute angle when said bendable members are unbent.

38. The wiping device of claim 35, wherein said bendable member forms an outer skirt around said body.

39. The wiping device of claim 38, wherein said outer skirt is coupled to said body at a region positioned at a distance from an end of said body.

40. The wiping device of claim 35, wherein:

said bendable member is movable from said unbent position to a first bent position which is closer to said body than said unbent position, and an outer dimension of said bendable member is greater in said unbent position than in said first bent position.

41. The wiping device of claim 40, wherein:

said bendable member is movable from said unbent position to a second bent position which is further away from said body than said unbent position, and said outer dimension of said bendable member is smaller in said unbent position than in said second bent position.

42. The wiping device of claim 35, wherein:

said body has a first end and a second end, and said wiping member is positioned between said first end and said second end.

43. The wiping device of claim 42, further comprising a protruding member protruding from said second end.

44. The wiping device of claim 42, wherein:

said bendable member is coupled to said body at a joining region, and said wiping member is positioned between said first end and said joining region.

45. The wiping device according to claim 35, wherein the bendable member is annular around said body.

46. An applicator unit comprising:

a container containing a cosmetic product;

a wiping device according to claim 35; and said applicator being immersed in said cosmetic product, wherein said applicator is configured to pass through said wiping device when the applicator is withdrawn from the container, so as to remove excess product from the applicator.

47. A wiping device comprising:

a body with two ends, each end defining an opening configured to receive an applicator;

a wiping member on an inner surface of said body and configured to wipe said applicator when said applicator passes through said body; and at least one bendable member protruding from an outer surface of said body so as to form an acute angle with said body when said bendable member is unbent, wherein said body defines an indentation having a form compatible with said bendable member.

48. The wiping device according to claim 47, wherein the wiping device is configured to be inserted in a container and, after the wiping device is mounted on the container, the bendable member is in a bent position and an outer dimension of said bendable member is greater in said bent position than in an unbent position.

49. An applicator unit comprising:

a container containing a cosmetic product;

a wiping device according to claim 47; and said applicator being immersed in said cosmetic product, wherein said applicator is configured to pass through said wiping device when the applicator is withdrawn from the container, so as to remove excess product from the applicator.

50. A wiping device comprising:

a body with two ends, each end defining an opening configured to receive an applicator;

a wiping member on an inner surface of said body and configured to wipe said applicator when said applicator passes though said body; and at least one bendable member protruding from an outer surface of said body so as to form an acute angle with said body when said bendable member is unbent, wherein said body defines an indentation in which said bendable member is positioned when said bendable member is bent against said body.

51. An applicator unit comprising:

a container containing a cosmetic product;

a wiping device according to claim 50; and said applicator being immersed in said cosmetic product, wherein said applicator is configured to pass through said wiping device when the applicator is withdrawn from the container, so as to remove excess product from the applicator.

52. A wiping device configured to be mounted on a container, said wiping device comprising:

a body;

a wiping member; and at least one movable member protruding from an outer surface of said body, wherein:

when said wiping device is inserted in said container, said movable member is movable from a first position to a second position which is closer to said body than said first position, and an outer dimension of said movable member is greater in said first position than in said second position, wherein, after said wiping device is mounted on said container, said movable member is in a third position which is further away from said body than said first position, said outer dimension of said movable member is smaller in said first position than in said third position, and the outer surface of the body has, facing the movable member, a depression configured to receive said movable member in said second position.

53. The wiping device of claim 52, further comprising a member protruding from an end of said body.

54. The wiping device of claim 53, wherein an outer dimension of said member protruding from said end of said body is smaller than said outer dimension of said movable member in said first position.

55. The wiping device of claim 54, wherein said outer dimension of said member protruding from said end of said body is greater than said outer dimension of said movable member in said second position.

56. The wiping device according to claim 52, wherein the movable member is annular around said body.

57. The wiping device of claim 52, wherein:

said body has a first end and a second end, said wiping member is positioned between said first end and said second end, said movable member is coupled to said body at a joining region, and said wiping member is positioned between said first end and said joining region.

58. An applicator unit comprising:

a container containing a cosmetic product;

an applicator immersed in said cosmetic product; and a wiping device according to claim 52, wherein said applicator is configured to pass through said wiping device when the applicator is withdrawn from the container, so as to remove excess product from the applicator.

59. A wiping device comprising:

a body with two ends, each end defining an opening configured to receive an applicator;

a wiping member on an inner surface of said body and configured to wipe said applicator when said applicator passes through said body; and at least one movable member protruding from an outer surface of said body, wherein:

said movable member is movable from a first position to a second position which is closer to said body than said first position, an outer dimension of said movable member is greater in said first position than in said second position, said body has a first end and a second end, said wiping member is positioned between said first end and said second end, said movable member is coupled to said body at a joining region, and said wiping member is positioned between said first end and said joining region.

60. The wiping device of claim 59, wherein an outer dimension of said first end is smaller than said outer dimension of said movable member in said second position.

61. The wiping device of claim 60, further comprising a member protruding from said second end.

62. The wiping device of 61, wherein said outer dimension of said first end is smaller than a outer dimension of said member protruding from said second end.

63. The wiping device of claim 62, wherein said outer dimension of said member protruding from said second end is smaller that said outer dimension of said movable member in said first position.

64. The wiping device of claim 63, wherein said outer dimension of said member protruding from said second end is greater than said outer dimension of said movable member in said second position.

65. An applicator unit comprising:

a container containing a cosmetic product;

a wiping device according to claim 59; and said applicator being immersed in said cosmetic product, wherein said applicator is configured to pass through said wiping device when the applicator is withdrawn from the container, so as to remove excess product from the applicator.

66. A wiping device comprising:

a body with two ends, each end defining an opening configured to receive an applicator;

a wiping member on an inner surface of said body and configured to wipe said applicator when said applicator passes through said body; and at least one bendable member protruding from an outer surface of said body, said bendable member having a surface which faces said body and which is connected to said body at an acute angle when said bendable member is unbent, wherein the outer surface of the body has, facing the at least one bendable member, a depression configured to receive said bendable member when said bendable member is bent against said body.

67. An applicator unit comprising:

a container containing a cosmetic product;

a wiping device according to claim 48; and said applicator being immersed in said cosmetic product, wherein said applicator is configured to pass through said wiping device when the applicator is withdrawn from the container, so as to remove excess product from the applicator.

* * * * *

UNITED STATES PATENT AND TRADEMARK OFFICE

CERTIFICATE OF CORRECTION

PATENT NO. : 7,186,044 B2
APPLICATION NO. : 10/175398
DATED : March 6, 2007
INVENTOR(S) : Christian Bailly It is certified that error appears in the above-identified patent and that said Letters Patent is hereby corrected as shown below:

In column 11, claim 31, line 34, change "poly0lefin" to --polyolefin--.

Signed and Sealed this

Seventeenth Day of July, 2007

JON W. DUDAS
*Director of the United States Patent and Trademark Office*